US010830416B2

(12) United States Patent
Hu et al.

(10) Patent No.: US 10,830,416 B2
(45) Date of Patent: Nov. 10, 2020

(54) LIGHT GUIDE COMPONENT AND LIGHT SOURCE DEVICE

(71) Applicant: APPOTRONICS CORPORATION LIMITED, Shenzhen (CN)

(72) Inventors: Fei Hu, Shenzhen (CN); Haixiong Hou, Shenzhen (CN)

(73) Assignee: APPOTRONICS CORPORATION LIMITED, Shenzhen (CN)

( * ) Notice: Subject to any disclaimer, the term of this patent is extended or adjusted under 35 U.S.C. 154(b) by 0 days.

(21) Appl. No.: 15/570,669

(22) PCT Filed: Apr. 29, 2016

(86) PCT No.: PCT/CN2016/080654
§ 371 (c)(1),
(2) Date: Oct. 30, 2017

(87) PCT Pub. No.: WO2016/173530
PCT Pub. Date: Nov. 3, 2016

(65) Prior Publication Data

US 2018/0292070 A1 Oct. 11, 2018

(30) Foreign Application Priority Data

Apr. 29, 2015 (CN) ..... 2015 2 0269101 U

(51) Int. Cl.
*F21V 7/05* (2006.01)
*F21V 9/20* (2018.01)
(Continued)

(52) U.S. Cl.
CPC ..... *F21V 7/05* (2013.01); *F21V 7/04* (2013.01); *F21V 7/28* (2018.02); *F21V 9/20* (2018.02);
(Continued)

(58) Field of Classification Search
None
See application file for complete search history.

(56) References Cited

U.S. PATENT DOCUMENTS 6,513,953 B1 * 2/2003 Itoh ..... G02B 3/0062 348/E9.027
7,023,620 B1 * 4/2006 Sandberg ..... G02B 27/126 359/618
(Continued)

FOREIGN PATENT DOCUMENTS

CN 102563410 A 7/2012
CN 103256567 A 8/2013
(Continued)

OTHER PUBLICATIONS

International Search Report in the parent PCT application No. PCT/CN2016/080654, dated Aug. 3, 2016.
(Continued)

*Primary Examiner* — Elmito Breval
(74) *Attorney, Agent, or Firm* — Chen Yoshimura LLP

(57) ABSTRACT

A light guide component and a light source device. The light guide component comprises a reflecting plate (131) having an aperture and a transflective coated plate (132). The reflecting plate (131) reflect light. The aperture allows light to pass through. The transflective coated plate (132) is connected to the reflecting plate (131) and covers the aperture, and transmits an excitation light and reflects light of a color different from that of the excitation light. The light source device comprises: an excitation light source (110), for generating excitation light; the light guide component, for transmitting, through the aperture and the transflective coated plate (132), the excitation light generated by the excitation light source (110); a color light generation device, for receiving the excitation light passing through the transflective excitation (132), and generating converted light by
(Continued)

using the excitation light; and a light collecting component, for collecting the converted light generated by the color light generation device. The light guide component can reduce waste of converted light.

9 Claims, 8 Drawing Sheets

(51) Int. Cl.

| | |
|---|---|
| ***F21V 13/14*** | (2006.01) |
| ***F21V 7/28*** | (2018.01) |
| ***F21V 9/30*** | (2018.01) |
| ***F21V 7/04*** | (2006.01) |
| ***F21V 13/08*** | (2006.01) |
| *F21V 5/00* | (2018.01) |
| *F21V 29/502* | (2015.01) |

(52) U.S. Cl.
CPC ..... *F21V 9/30* (2018.02); *F21V 13/08* (2013.01); *F21V 13/14* (2013.01); *F21V 5/008* (2013.01); *F21V 29/502* (2015.01)

(56) References Cited

U.S. PATENT DOCUMENTS

| | | | | |
|---|---|---|---|---|
| 9,075,293 | B2 | 7/2015 | Zhang et al. | |
| 2007/0195330 | A1* | 8/2007 | Ohashi | A61B 5/0059 356/498 |
| 2008/0247022 | A1* | 10/2008 | Yamauchi | G02B 27/48 359/211.1 |
| 2011/0090465 | A1* | 4/2011 | Watanabe | G03B 21/28 353/31 |
| 2013/0038847 | A1* | 2/2013 | Katou | G02B 5/26 353/98 |
| 2013/0194551 | A1 | 8/2013 | Zhang et al. | |
| 2013/0250253 | A1* | 9/2013 | Ogura | F21V 13/08 353/85 |
| 2013/0250546 | A1* | 9/2013 | Hu | F21V 9/40 362/84 |
| 2014/0285772 | A1 | 9/2014 | Tajiri | |
| 2014/0285774 | A1 | 9/2014 | Tajiri | |
| 2015/0222864 | A1* | 8/2015 | Inoko | F21V 9/14 353/31 |
| 2016/0026076 | A1* | 1/2016 | Hu | G03B 21/204 353/84 |

FOREIGN PATENT DOCUMENTS

| | | | |
|---|---|---|---|
| CN | 104062836 | A | 9/2014 |
| CN | 104062837 | A | 9/2014 |
| CN | 204028554 | U | 12/2014 |
| CN | 204593250 | U | 8/2015 |
| WO | 2014/135040 | A1 | 9/2014 |

OTHER PUBLICATIONS

IPRP in the parent PCT application No. PCT/CN2016/080654, dated Oct. 31, 2017.

Japanese Office Action, dated Jul. 10, 2018 in a counterpart Japanese patent application, No. JP 2017-556202.

* cited by examiner

LIGHT GUIDE COMPONENT AND LIGHT SOURCE DEVICE

BACKGROUND OF THE INVENTION

Field of the Invention

This invention relates to light sources, and in particular, it relates to a light guide component and a light source device using the same.

Description of Related Art

Conventional laser light sources typically use etendue based light separation and light combination. They employ a coated plate with multiple coated regions; typically, the coated plate has multiple regions that are coated with different multilayer film systems. Due do the limitations in the fabrication techniques of coated plates, it is difficult to coat different types of multilayer film systems on different regions of the same coated plate. Also, sometimes one of the regions is a light transmission region that does not need any coating, but conventional coating processes will result in such regions being covered with films. This results in waste as well as difficulties in removing the films from such regions.

SUMMARY

Another problem in conventional light source systems that use coated plates as light guide components is that some converted light is wasted. As shown in FIG. 1, in a conventional light source device, the conventional coated plate 100 is disposed at an angle, and the light transmitting aperture in its center transmits an excitation light 201 generated by an excitation light source. Take the example of a blue excitation light source, the excitation light 201 passes through the light collecting component 140, and is condensed to the wavelength conversion material 153 on the wavelength conversion device. In FIG. 1, the light collecting component 140 is formed by three lenses with curved surfaces. As shown in FIG. 2, the wavelength conversion material 153 uses the excitation light to generate a white converted light or a converted light having mixed colors. Take white light as an example, due to the reflectivity of the coated plate, a majority of the white light 204 is reflected by the coated plate 100 and then emitted from the light source device. Some of the blue light 202 that is not absorbed by the wavelength conversion material 153 and light 203 of the non-blue color components of the white light pass through the aperture of the coated plate 100 and are wasted.

In a first aspect, the present invention provides a light guide component, which includes: a reflecting plate having an aperture, wherein the reflecting plate reflects light and the aperture transmits light; and a transflective coated plate, which transmits light in a first wavelength range and reflects light in other wavelength ranges, wherein the transflective coated plate is joined to the reflecting plate and at least partially covers the aperture, i.e., the transflective coated plate is connected to the reflecting plate and at least partially covers the aperture.

The transflective coated plate is stacked with the reflecting plate and covers the aperture, or the transflective coated plate is inlayed in the aperture.

The reflecting plate includes at least two individual reflecting plates, each individual reflecting plate having a slot along one edge which extend through and between two opposing surfaces of the reflecting plate, and wherein the at least two individual reflecting plates are joined together on the sides that have the slots to form the aperture. Or, the reflecting plate includes at least two individual reflecting plates, which are joined together to surround the aperture.

An etendue of the aperture is less an or equal to ¼ of an etendue of the reflecting plate.

In a second aspect, the present invention provides a light source device, which includes: an excitation light source for generating an excitation light (i.e. the light of the first wavelength range); the above light guide component, disposed on an optical path of the excitation light; a color light generating device, disposed on an optical path of the excitation light after the excitation light has passed through the transflective coated plate, for receiving the excitation light and using the excitation light to generate a converted light which travels toward the reflecting plate of the light guide component.

The light guide component is disposed such that the angle formed between its reflective plane and a plane that contains the optical path of the excitation light and that is perpendicular to a horizontal plane is greater than 0 degrees and smaller than 90 degrees.

The color light generating device further reflects unused excitation light to the light guide component.

An etendue of the aperture is less an or equal to ¼ of an etendue of the reflecting plate.

The reflecting plate has a hemispherical or hemi-ellipsoidal shape, wherein its inner surface is reflective; the color light generating device includes a wavelength conversion material that converts the excitation light into the converted light, and a light collecting device for collecting the excitation light.

When the reflecting plate has a hemi-ellipsoidal shape, a light entrance port of the light collecting device is approximately centered at a focal point of the reflecting plate, and the color light generating device is disposed such that a light illumination spot on the wavelength conversion material is located approximately at the other focal point of the reflecting plate.

When the reflecting plate has a hemispherical shape, the light entrance port of the light collecting device is located near a spherical center of the reflecting plate, and the color light generating device is disposed such that the light illumination spot on the wavelength conversion material is located at the spherical center of the reflecting plate and opposite to the light entrance port, or the color light generating device is disposed such that the light illumination spot on the wavelength conversion material is located near the spherical center of the reflecting plate at a point symmetrical to the light entrance port with respect to the spherical center.

Using the light guide component according to embodiments of the present invention, on the one hand, the light guide component can reduce waste of the converted light. As shown in FIG. 3, the light guide component includes a reflecting plate 131 and a transflective coated plate 132, where a central aperture of the reflecting plate 131 is covered by the transflective coated plate 132. In use, as shown in FIG. 4, the reflecting plate 131 and the transflective coated plate 132 form the light guide component, which is disposed in a slanted manner in the light source device. The central aperture transmits the excitation light 201 generated by the excitation light source. Take blue excitation light as an example, the transflective coated plate 132 can transmit blue light and reflect other color lights. The blue excitation light 201 is collected by the light collecting device 140 and condensed to the wavelength conversion material 153 of the wavelength conversion device. As shown in FIG. 5, the wavelength conversion material 153 uses the excitation light to generate a white converted light or a mixed color converted light. Take white light as an example, because of the reflectivity of the reflecting plate 131, a majority of the white light 204 is reflected by the reflecting plate 131 and output by the light source device. Converted light 203 having a color other than blue is reflected by the transflective coated plate 132 and utilized for output. Only the blue light 202 not used by the wavelength conversion material 153 is wasted. Compared to conventional technology, the converted light 203 having a color other than blue is saved. A very small portion of the blue excitation light 201, after entering the light collecting device 140, due to the reflection and refraction of the light collecting device 140, is not utilized by the wavelength conversion material 153 and is outputted from the light collecting device 140. This portion of the light is the blue light 202 shown in FIG. 5 (i.e., the blue light 202 is the excitation light that is reflected through the light collecting device 140 back to the transflective coated plate 132, and not generated by the wavelength conversion material 153). Those skilled in the relevant art should understand that, when the wavelength conversion material 153 utilizes the blue excitation light 201, it can generate a small amount of blue light; such light, when it reaches the transflective coated plate 132, is also transmitted through the transflective coated plate 132 in a similar manner as the blue light 202.

On the other hand, as shown in FIG. 6, when coating the conventional coated plate 100, because the reflective coating surface 101 is used to reflect the converted light, and the transmissive coating surface 102 is used to transmit the converted light, the reflective coating surface 101 and the transmissive coating surface 102 need to be coated with different multilayer film systems. As a result, the edges 103 where the reflective coating surface 101 and the transmissive coating surface 102 contact each other can form gaps, or the different film systems may overlap each other and become non-flat. These problems can cause loss in light reflection or transmission efficiency, as well as reliability problems. FIG. 7 shows an example of the light guide component of an embodiment of the present invention, where the reflecting plate is formed by a first plate 001, a second plate 002, a third plate 003 and a fourth plate 004 joined together. The individual plates are coated with the same multilayer film system. The transflective coated plate 132 is coated with a different multilayer film system, and is joined to the reflecting plate using structural connections. As a result, the contact edge 005 between the reflecting plate and the transflective coated plate 132 can be straight, and will not form gaps or have problems of the different film systems overlapping each other.

Thus, embodiments of the present invention have the following advantages: It saves a portion of the light of different colors than the excitation light which is wasted in the conventional technology using the conventional coated plate; the contact edge of different film systems on the light guide component can be straight and will not form gaps or have problems of the different film systems overlapping each other.

DETAILED DESCRIPTION OF PREFERRED EMBODIMENTS

Embodiments of the present invention are described in detail with reference to the drawings.

First Embodiment

Figure 1:
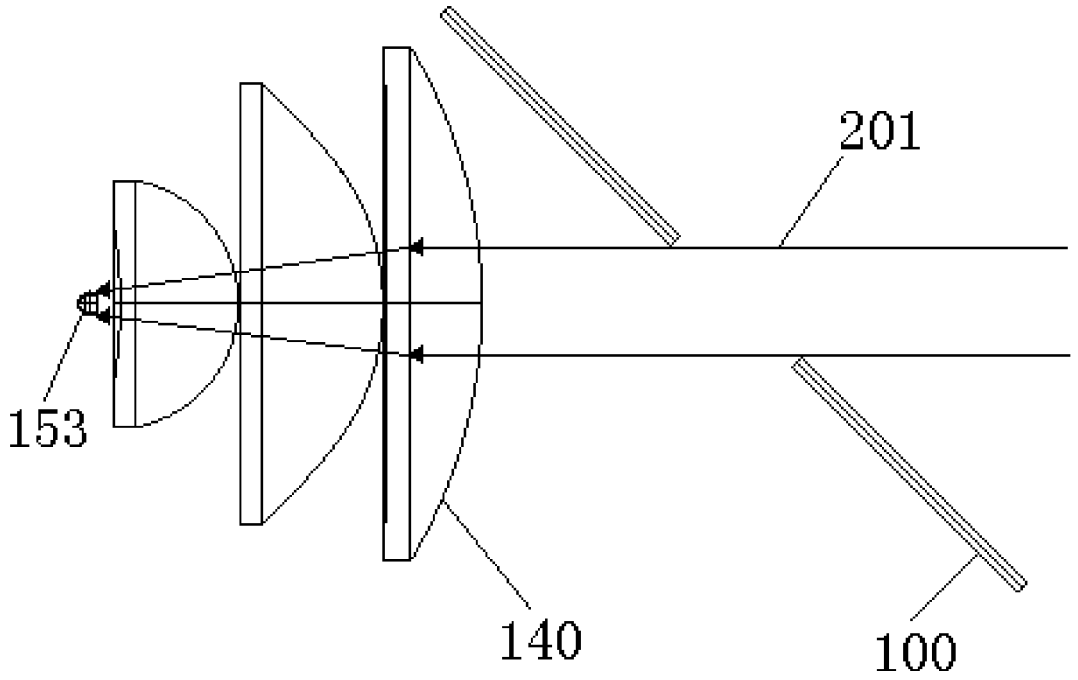
FIG. 1 illustrates the principle of the excitation light passing through the coated plate according to conventional technology.
Figure 2:
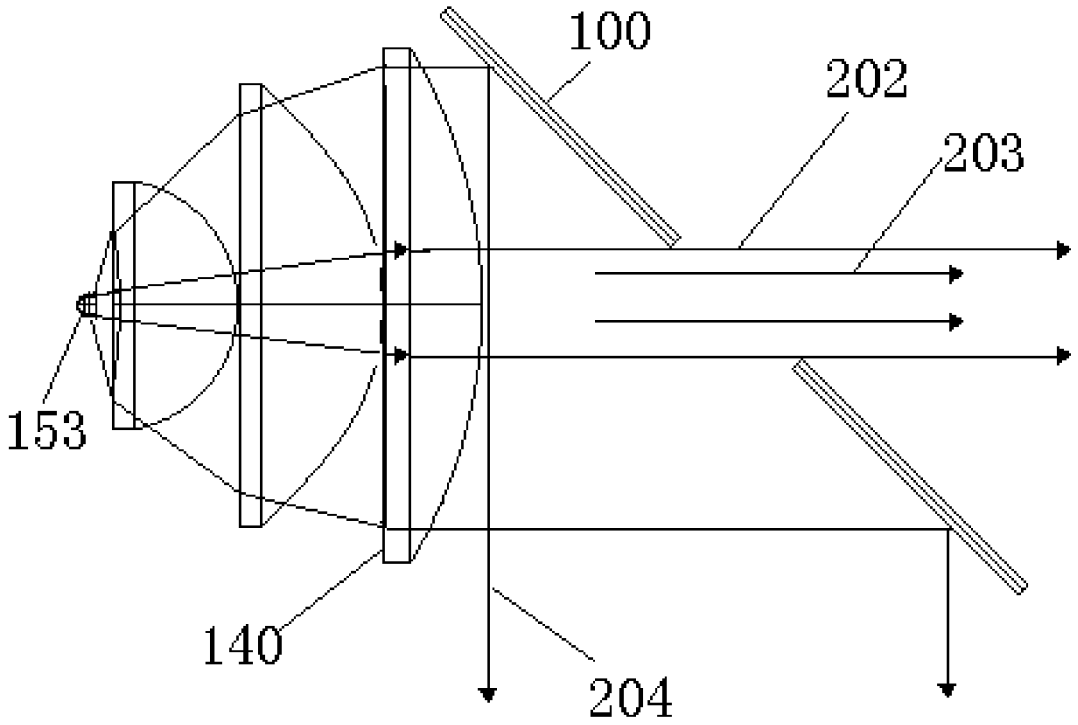
FIG. 2 illustrates the principle of the converted light reflected by the coated plate according to the conventional technology.
Figure 3:
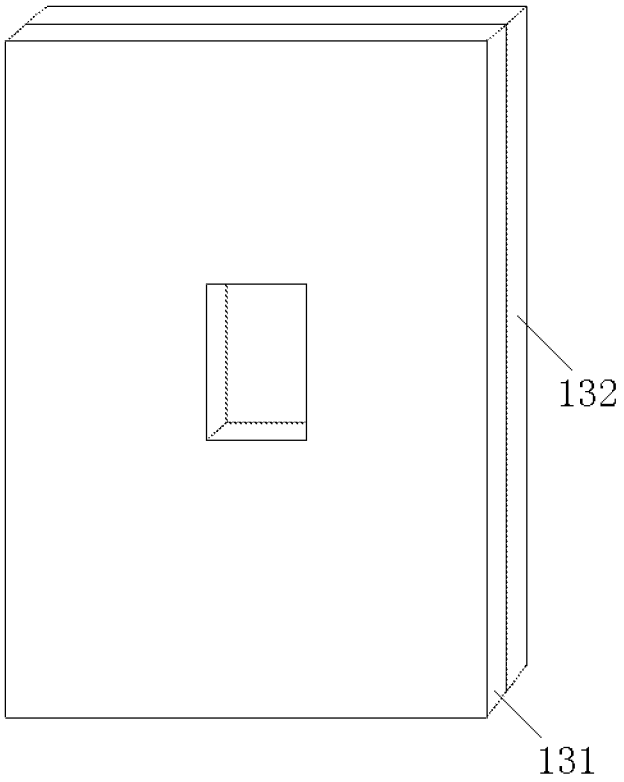
FIG. 3 schematically illustrates the structure of a light guide component according to a first embodiment of the present invention.
Figure 4:
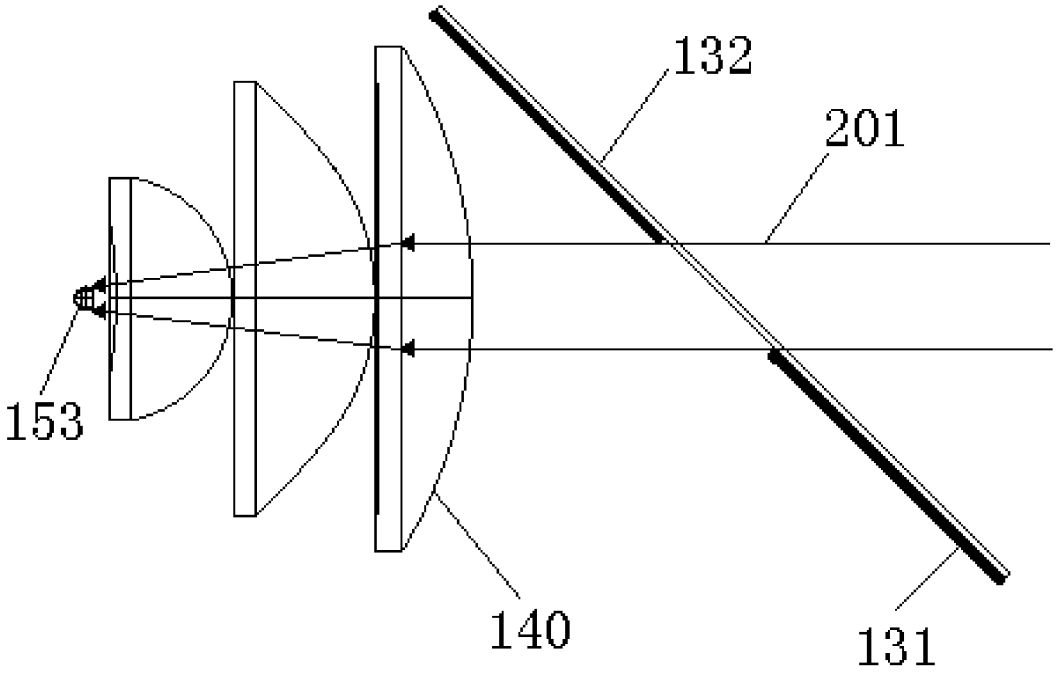
FIG. 4 illustrates the principle of the excitation light passing through the light guide component according to the first embodiment.
Figure 5:
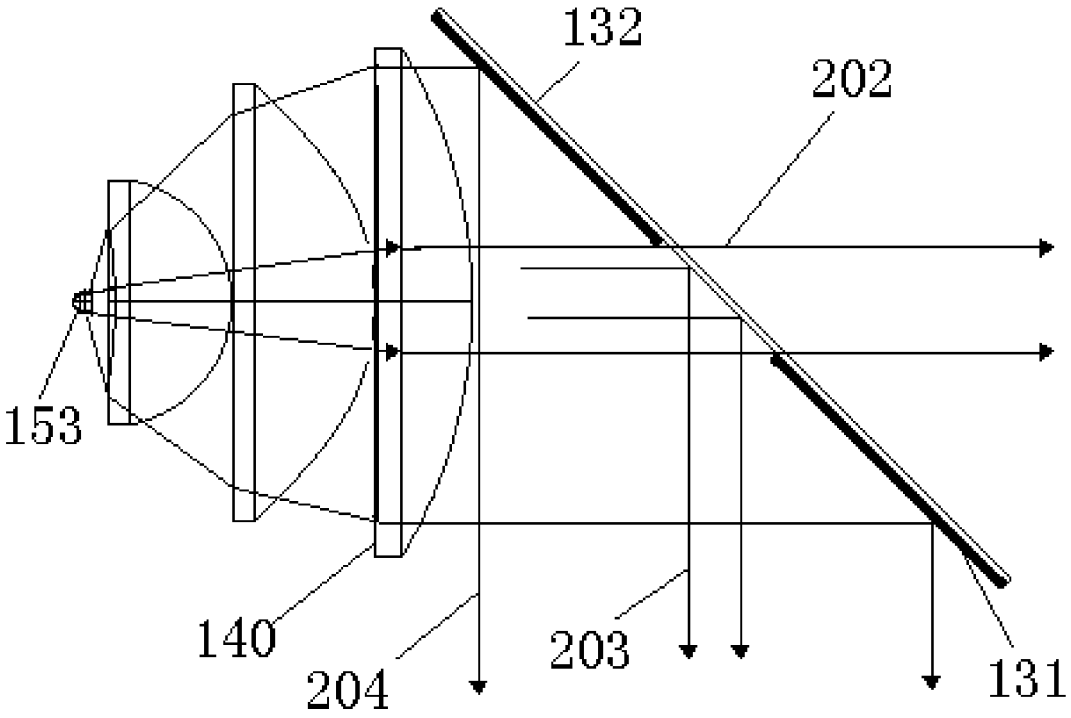
FIG. 5 illustrates the principle of the converted light reflected by the light guide component according to the first embodiment.
Figure 6:
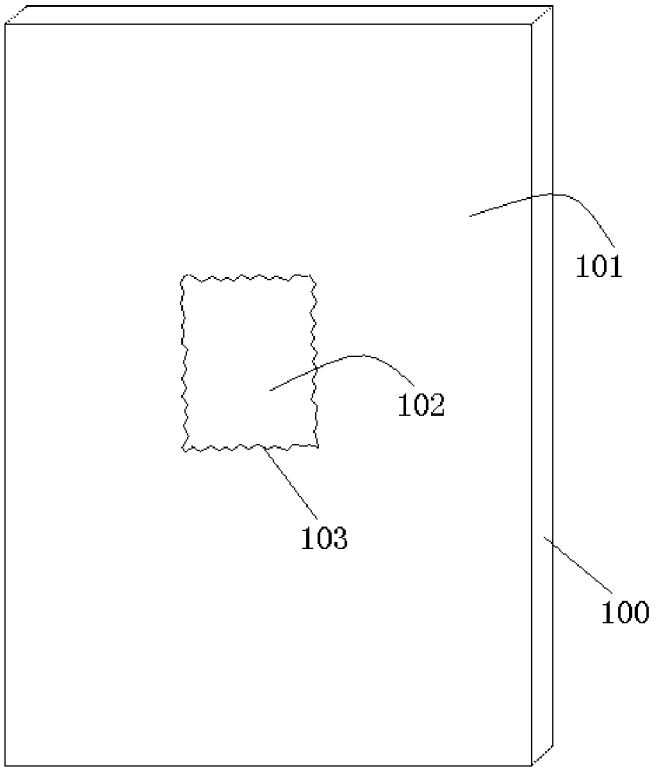
FIG. 6 schematically illustrates the structure of a coated plate coated with two multilayer film systems according to conventional technology.

The light guide component of this embodiment is shown in FIG. 3, and includes a reflecting plate 131 and a transflective coated plate 132. An aperture located in a central area of the reflecting plate 131 is covered by the transflective coated plate 132. The reflecting plate 131 may be made of a metal material. Because a metal plate can be processed into any desired shape, in this embodiment, it is a relatively easy process to form the aperture in the reflecting plate 131. In use, as shown in FIG. 4, in the light source device, the surface of the light guide component forms a 45-degree angle relative to the optical path of the excitation light. The central aperture transmits the blue excitation light 201 (blue laser light) generated by the excitation light source. The transflective coated plate 132 can transmit blue light and reflect lights having colors other than blue. The blue excitation light 201 is condensed by the light collecting device 140 onto the wavelength conversion material 153 on the wavelength conversion device. As shown in FIG. 5, the wavelength conversion material 153 uses the blue excitation light to generate a white converted light or a converted light having mixed colors (such as a red, green and blue light sequence). Take white light as an example, due to the reflectivity of the reflecting plate 131, a majority of the white light 204 is reflected by the reflecting plate 131 and then emitted from the light source device. The converted light 203 having a non-blue color is also reflected by the transflective coated plate 132 and can be utilized as output light. Only a small portion of the blue light 202 passes through the transflective coated plate 132 and is not utilized for output.

In other embodiments, the converted light may be a single color light, such as yellow light; then the transflective coated plate may be one that transmits blue light and reflects yellow light. The converted light may be a mixed color light, such as when the excitation light includes red and blue lights, and the converted light is green light; then the transflective coated plate may be one that transmits red and blue lights and reflects green light.

Second Embodiment

Figure 8:
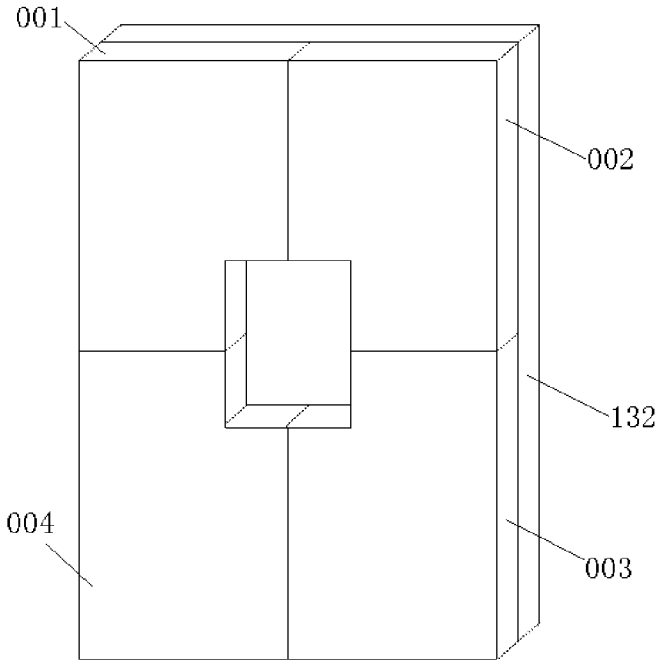
FIG. 8 schematically illustrates the structure of a light guide component according to a second embodiment of the present invention.

As shown in FIG. 8, in the light guide component of this embodiment, the reflecting plate is formed by a first plate 001, a second plate 002, a third plate 003 and a fourth plate 004 joined together. The individual plates are coated with the same multilayer film system. The transflective coated plate 132 is coated with a different multilayer film system, and is disposed on the other side of the reflecting plate and covers the aperture of the reflecting plate. One reason for using four individual plates jointed together to form the reflecting plate is that for reflecting plates made of some materials, it may not be easy to form the central aperture directly on a reflecting plate, so multiple individual plates are jointed together to form the reflecting plate. The light guide component of this embodiment may be used in the same manner as in the first embodiment, and the description is omitted here. Those skilled in the art will appreciate that the reflecting plate may also be formed by joining two, three, or other numbers of individual plates, and they are variations of this embodiment.

Third Embodiment

Figure 9:
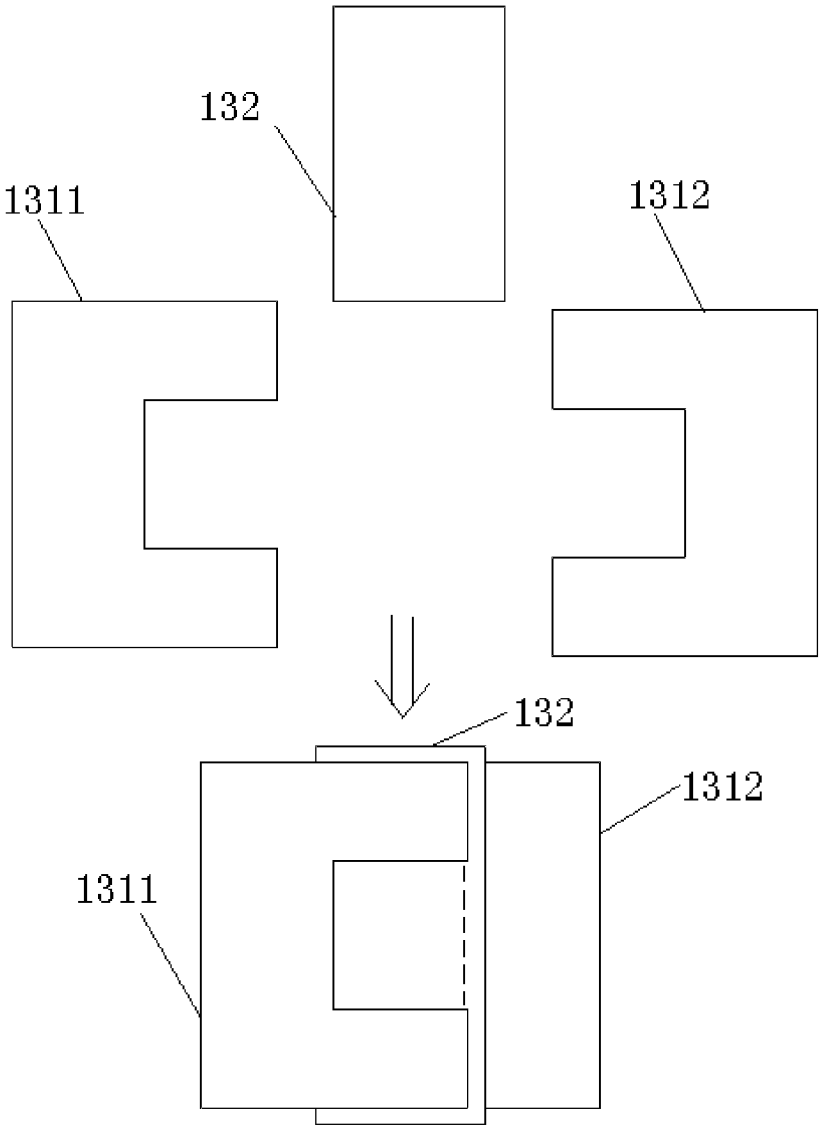
FIG. 9 schematically illustrates the assembly principle of a light guide component according to a third embodiment of the present invention.

As shown in FIG. 9, in the light guide component of this embodiment, the reflecting plate is formed by a fifth plate 1311 and a sixth plate 1312 joined together. Overlapping portions of the two individual plates are stacked, and the transflective coated plate 132 is sandwiched between the stacked portions of the two plates. This way, the transflective coated plate 132 covers the aperture formed between the two plates. Compared to the first and second embodiments, the size of the transflective coated plate 132 required for this embodiment is smaller but can achieve the same effect. The light guide component of this embodiment may be used in the same manner as in the first embodiment, and the description is omitted here.

Fourth Embodiment

Figure 10:
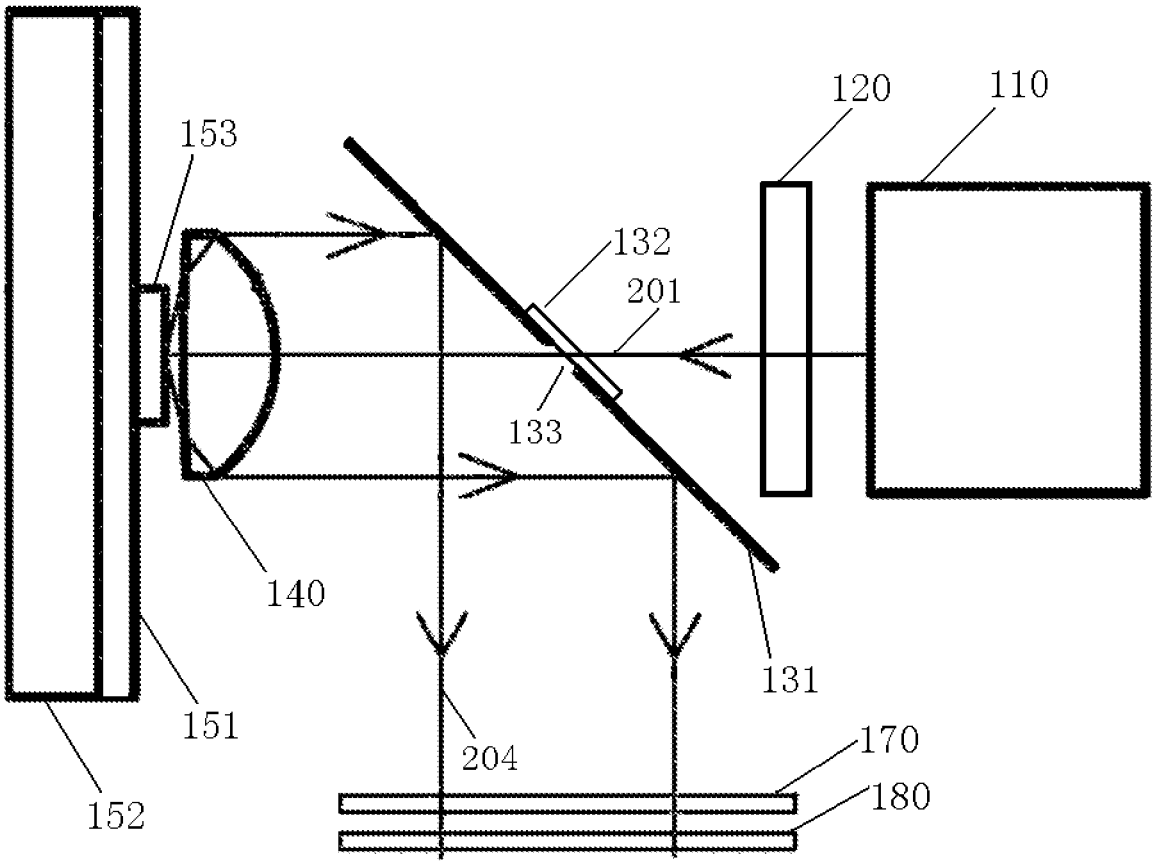
FIG. 10 illustrates a light source device according to a fourth embodiment of the present invention.

This embodiment provides a light source device as shown in FIG. 10, which includes an excitation light source 110, a fly-eye lens array 120, a light guide component, a lens set 140, a wavelength conversion device, and a filter plate 180. The light guide component is formed by the reflecting plate 131 and the transflective coated plate 132. The wavelength conversion device is formed by a substrate 151, a heat dissipating device 152, and a wavelength conversion material 153. The lens set 140 corresponds to the light collecting device of the first embodiment. The wavelength conversion device and the lens set 140 collectively form a color light generating device.

The size of the transflective coated plate 132 may be smaller than that of the reflecting plate 131, or may be larger than the size of the central aperture 133 of the reflecting plate 131. To separate the optical paths of the converted light and the excitation light, the aperture 133 should have an etendue that is less than or equal to ¼ of the etendue of the reflecting plate 131.

In optics, etendue is used to describe the area and angular distribution of light in space. The wavelength conversion material 153 enlarges the etendue of the light.

The blue excitation light 201 from the excitation light source 110 passes through the aperture 133 and is directly incident on the wavelength conversion material 153. The white converted light 204 emitted from the wavelength conversion material 153 has a near-Lambertian distribution, and the etendue is increased significantly. The white converted light 204 and the portion of the blue excitation light that is not absorbed by the wavelength conversion material 153 travel toward the lens set 140, and are collected by the lens set 140 to form a near-parallel light beam traveling toward the reflecting plate 131. Thus, a majority of the converted light 204 is reflected by the reflecting plate 131 with aperture and is effectively utilized for output; a small portion of the blue converted light is transmitted through the aperture 133 and become lost. The light incident on the transflective coated plate 132, other than the blue converted light, is also reflected and utilized for output. Because the excitation light 201 generated by the excitation light source 110 has a relatively small etendue, the aperture 133 can be made to occupy a very small portion of the size of the entire reflecting plate 131. The converted light 204 collected by the lens set 140 has a relatively large etendue, so the loss through the aperture 133 can be controlled to within an acceptable ratio.

The wavelength conversion device includes a substrate 151 having a reflective surface (such as a heat sink), and the wavelength conversion material 153 is disposed on the reflective surface. The heat dissipating device 152 that is in direct and tight contact with the substrate 151 helps the heat dissipation of the wavelength conversion material 153, which helps to maintain the light conversion efficiency.

The fly-eye lens array 120 is a light homogenizing device disposed between the excitation light source 110 and the light guide component, and can homogenize and shape the light beam. For example, it may be a rectangular fly-eye lens array of aspect ratio 4:3. Based on the different requirements of practical applications such as projector, stage lighting, television, search light, etc., the light homogenizing device may use other lens arrays, or a hollow or solid light rod, or even a diffusor plate.

The filter plate 180 disposed at the light output port of the light source device can be used to adjust the spectrum of the output light of the light source device. When the filter plate 180 is chosen to have characteristics that reflect the excitation light and transmit the converted light, the light source device can output a converted light of a pure color. Meanwhile, the unabsorbed excitation light is reflected by the reflecting plate 131 back to the wavelength conversion material 153 to be recycled and used a second or more times. This arrangement can improve the color purity of the output light. The film 170 on the filter plate 180 may be a brightness enhancement film or a diffractive optical film. Or, a brightness enhancement plate or a polarizing reflector plate may be directly used to replace the film 170 and the filter plate 180, to enhance the brightness of the output light of the light source device or to generate a polarized output light. These films and/or plates may also be disposed on the surface of the wavelength conversion device, in particular the wavelength conversion material 153.

The light guide component shown in FIG. 10 is disposed at an angle so that the input light and the output light form a 90-degree angle relative to each other. It can also be disposed at other angles so that the input light and the output light form a non-90-degree angle.

Figure 7:
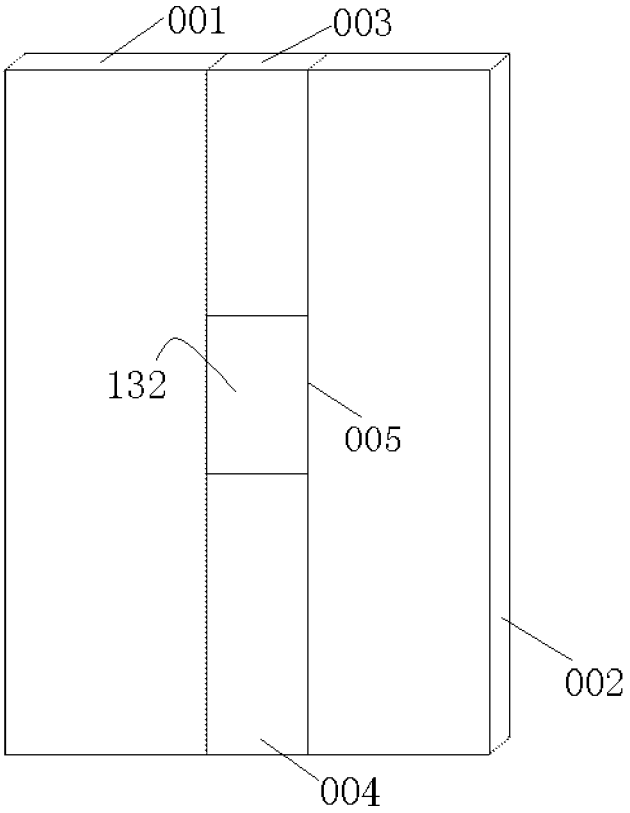
FIG. 7 schematically illustrates the structure of a light guide component according to an embodiment of the present invention.

In FIG. 10, the light guide component is disposed such that its reflective surface and the optical path of the excitation light form an angle greater than 0 degrees and less than 90 degrees. When there are gaps on the light guide component (such as shown in FIG. 7, the gap where the transflective coated plate and the reflecting plate contact each other and the gap where the individual plates contact each other), if the light guide component is disposed perpendicularly to the optical path of the excitation light, the excitation light can pass through the gaps and form a light spot having the same shape as the gaps. This light spot is not effectively utilized, which is undesirable. When the light guide component is disposed such that its reflective surface and the optical path of the excitation light form an angle greater than 0 degrees and less than 90 degrees, because the gaps are slanted, the light spot formed by the excitation light after passing through the gap is narrower, so its effect can be ignored.

For example, the light guide component may be disposed such that its reflective surface and the optical path of the excitation light form a 45-degree angle. Because the projection of the gaps on a plane perpendicular to the optical axis is a straight line, this angle of the reflecting plate can reduce the impact of the gap on the light beam, i.e., the projection of the extending direction of the gap on the horizontal plane is parallel to the light beam.

The shape of the reflecting plate 131 may be round, oval, rectangular, or even irregular shapes. Further, the reflecting plate 131 may be replaced by a reflective mirror with a curved surface, or a solid piece with a certain shape and a reflective surface, where the shape of the curved surface may be spherical, ellipsoidal, paraboloidal, or a free shape.

Fifth Embodiment

Figure 11:
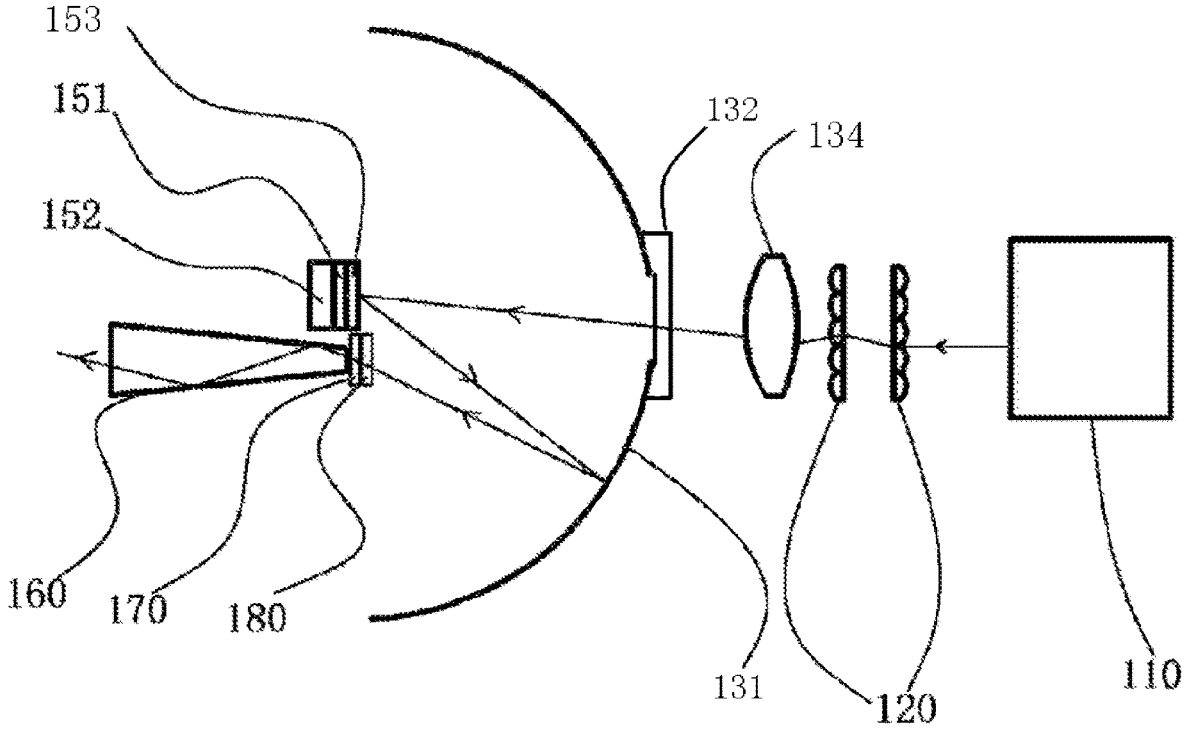
FIG. 11 illustrates a light source device according to a fifth embodiment of the present invention.

The light source device of this embodiment is shown in FIG. 11. Similar to the fourth embodiment, it includes an excitation light source 110, a fly-eye lens array 120, a light guide component, a lens set 140, a wavelength conversion device, a filter plate 180, and film 170 of the filter plate 180. The light guide component is formed by the reflecting plate 131 and the transflective coated plate 132. The wavelength conversion device is formed by a substrate 151, a heat dissipating device 152, and the wavelength conversion material 153. The functions of these components are similar to those in the fourth embodiment and not described in further detail here. The focusing lens 134 focuses the excitation light to the aperture of the light guide component.

Different from the earlier embodiment, in this embodiment, the reflecting plate 131 has a hemi-ellipsoidal shape, and a square cone shaped light rod 160 is disposed such that its light entrance port is approximately centered at a focal point of the reflecting plate 131. The wavelength conversion device is disposed such that the light illumination spot on the wavelength conversion material 153 is located approximately at the other focal point of the reflecting plate 131. This way, the converted light generated by the wavelength conversion material 153 upon absorbing the excitation light is illuminated on the inner surface of the reflecting plate 131, and is reflected and focused onto the light entrance port of the light rod 160 (i.e., the location of the filter plate 180 in the drawing).

In an alternative embodiment, the reflecting plate 131 may be a hemispherical shape, and the light entrance port of the light rod 160 is located near the spherical center of the reflecting plate. The wavelength conversion device is disposed such that the light illumination spot on the wavelength conversion material 153 is located at the spherical center of the reflecting plate at a point opposite of to the light entrance port. Of course, those skilled in the art will be able to design reflecting plates of other suitable shapes, and correspondingly adjust the arrangement of the optical paths. These arrangements are within the scope of the present invention.

Sixth Embodiment

Figure 12:
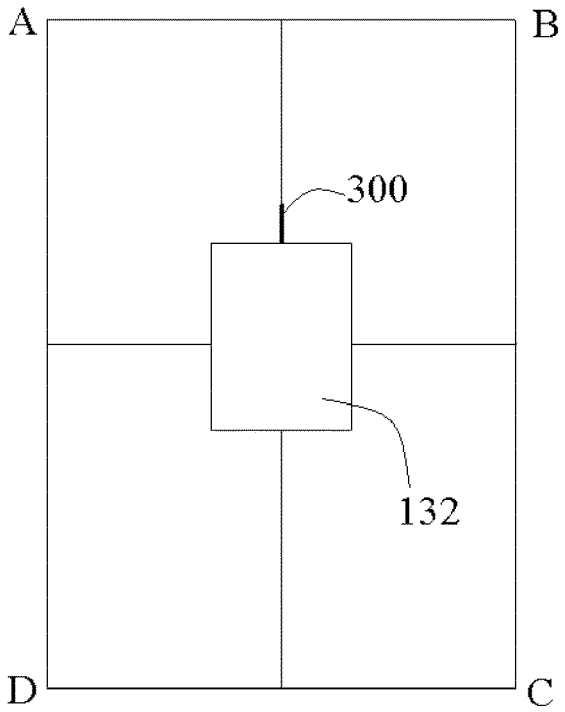
FIG. 12 schematically illustrates the structure of a light guide component according to a sixth embodiment of the present invention.

In the light source device of this embodiment, the light guide component is formed by multiple individual plates joined together. More specifically, as shown in FIG. 12, the light guide component is similar to that shown in FIG. 8 in that it is formed by joining together four individual reflective plates, which are coated with the same multilayer film system. The transflective coated plate 132 is coated with a different multilayer film system, and is disposed on the other side of the reflecting plate and covers the aperture of the reflecting plate. Those skilled in the art will be able to design other ways of joining individual pieces to form the light guide component, such as the design shown in FIG. 7. The light guide component is a plate shape, and its plane is defined as ABCD as shown in in the drawing.

A small gap 300 may exist between two individual plates where they are joined. Although such gap is undesirable, it is difficult to avoid. The description of this embodiment is for the case where a small gap exists in the reflecting plate of the light guide component in the light source device.

A difference between this embodiment and the fourth embodiment is that, the light guide component is disposed such that the angle formed between its plane and a plane that contains the optical path of the excitation light and that is perpendicular to the horizontal plane is greater than 0 degrees and smaller than 90 degrees. The novelty of this feature is discussed below.

Figure 13:
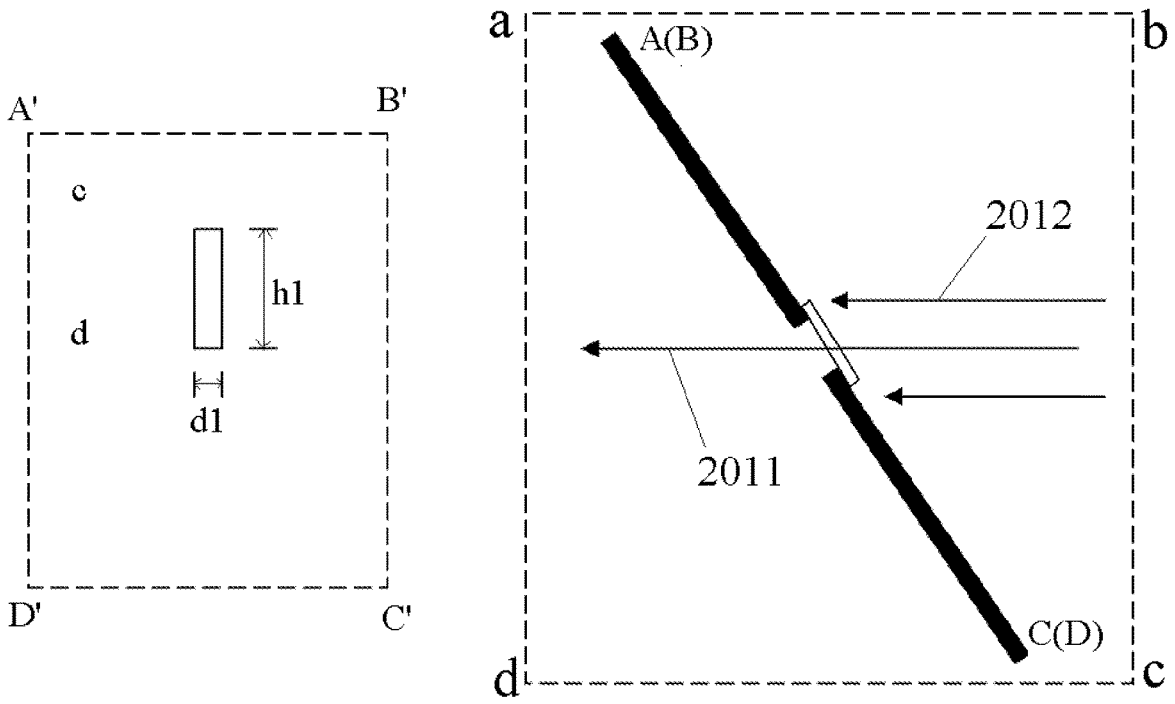
FIG. 13 illustrates the principle of a light guide component causing a light spot.

FIG. 13 shows a hypothetical case where the light guide component is disposed such that the angle formed between its plane ABCD and the plane abcd that contains the optical path of the excitation light and that is perpendicular to the horizontal plane is equal to 90 degrees. Although the excitation light is typically considered a straight line, the excitation light beam still has a certain width, so a portion 2012 of the excitation light can fall on the reflecting plate. The portion 2011 of the excitation light that directly pass through the aperture is utilized normally, and is not discussed further. Due to the presence of the gap 300 on the reflecting plate, a portion 2012 of the excitation light can pass through the gap 300 and form a light spot on the plane A'B'C'D' of the lens set. The width of the light spot is denoted d1 and its height is denoted h1. FIG. 13 is for illustration purpose only; the plane A'B'C'D' of the lens set may be a spherical surface or an arc surface, and the plane A'B'C'D' is not on the same plane as the plane abcd.

Figure 14:
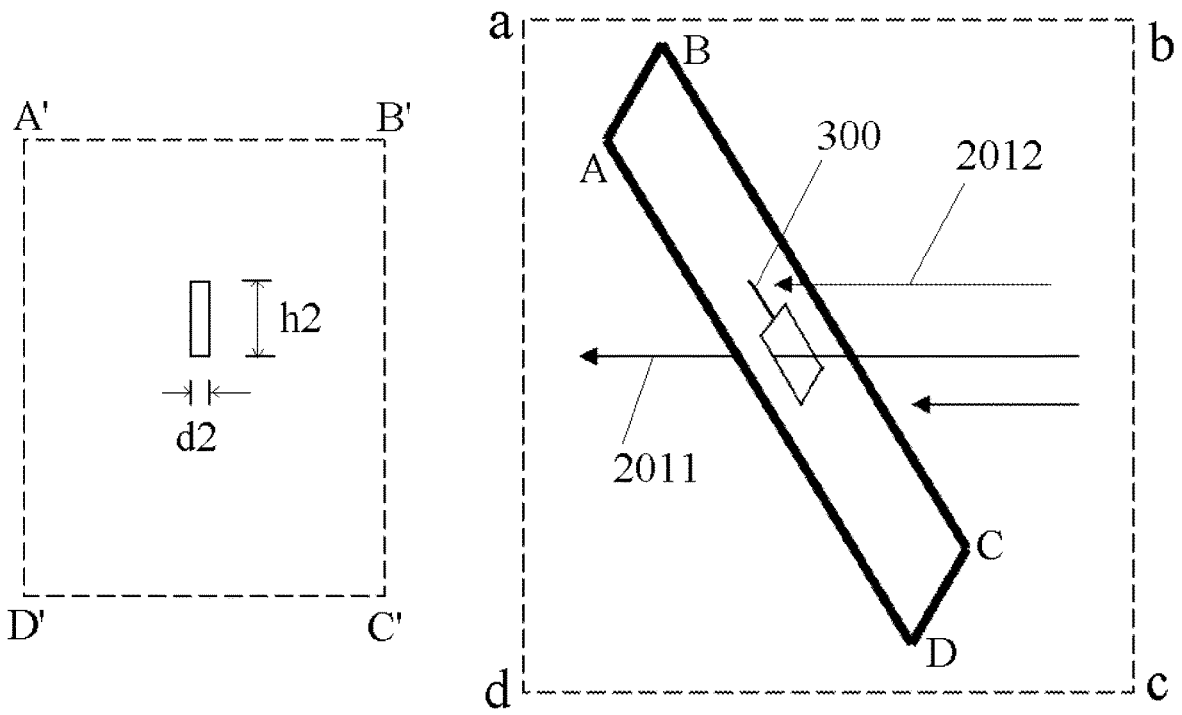
FIG. 14 illustrates the principle of the light guide component of the sixth embodiment of the present invention causing a light spot.

The hypothetical case shown in FIG. 13 is used to provide a comparison with the disposition of the light guide component of the present embodiment. In the present embodiment, the light guide component is disposed such that the angle formed between its plane ABCD and the plane abcd that contains the optical path of the excitation light and that is perpendicular to the horizontal plane is greater than 0 degrees and smaller than 90 degrees, as shown in FIG. 14. Again, the portion 2011 of the excitation light that directly pass through the aperture is not discussed further. The light spot formed on the plane A'B'C'D' of the lens set by the portion 2012 of the excitation light that passes through the gap 300 has a width d2 and height h2, where d2 is smaller than d1 and h2 is smaller than h1. The light spot formed on the lens set by the portion of the excitation light passing through the gap can cause undesirable effects, for example, the excitation light impinging on the lens set or the wavelength conversion material is not uniform overall, and the downstream converted light impinging on the reflecting plate is not uniform, etc. The larger the light spot (i.e. the more excitation light that passes through the gap), the more significant the undesirable effect. Thus, in this embodiment, the angle formed between the plane ABCD of the light guide component and the plane abcd that contains the optical path of the excitation light and that is perpendicular to the horizontal plane is controlled to be a suitable angle greater than 0 degrees and smaller than 90 degrees, so that it can make the light spot thinner or can even eliminate the light spot. This can reduce the impact of the excitation light passing through the gap. Other aspects of this embodiment are similar to those of the fourth embodiment and will not be described in further detail here.

It will be apparent to those skilled in the art that various modification and variations can be made in the light source device and method of the present invention without departing from the spirit or scope of the invention. Thus, it is intended that the present invention cover modifications and variations that come within the scope of the appended claims and their equivalents.

What is claimed is:

1. A light guide component, comprising:

a reflecting plate having an aperture, wherein the reflecting plate reflects light and the aperture transmits light, wherein the reflecting plate includes at least two individual reflecting plates which are disposed in a same plane and joined together to completely surround the aperture; and a transflective coated plate, which transmits light in a first wavelength range and reflects light in other wavelength ranges, wherein the transflective coated plate is inlayed in the aperture with all edges of the transflective coated plate disposed against edges of the aperture and joined to the reflecting plate, wherein at least two edges of the transflective coated plate are joined to different individual reflecting plates, wherein the transflective coated plate covers the aperture.

2. The light guide component of claim 1, wherein each individual reflecting plate has a slot along one edge which extend through and between two opposing surfaces of the reflecting plate, and wherein the at least two individual reflecting plates are joined together on the sides that have the slots to form the aperture.

3. The light guide component of claim 1, wherein an etendue of the aperture is less than or equal to ¼ of an etendue of the reflecting plate.

4. A light source device, comprising:

an excitation light source for generating an excitation light;

a light guide component of claim 1, disposed on an optical path of the excitation light;

a color light generating device, disposed on an optical path of the excitation light after the excitation light has passed through the transflective coated plate, for receiving the excitation light and using the excitation light to generate a converted light which travels toward the reflecting plate of the light guide component.

5. The light source device of claim 4, wherein the light guide component is disposed such that the angle formed between its reflective plane and a plane that contains the optical path of the excitation light and that is perpendicular to a horizontal plane is greater than 0 degrees and smaller than 90 degrees.

6. Light source device of claim 4, wherein the color light generating device further reflects unused excitation light to the light guide component.

7. The light source device of claim 4, wherein the light in the first wavelength range is the excitation light.

8. The light source device of claim 4, wherein the reflecting plate has a hemispherical or hemi-ellipsoidal shape, wherein its inner surface is reflective;

wherein the color light generating device includes a wavelength conversion material that converts the excitation light into the converted light, and a light collecting device for collecting the excitation light;

wherein when the reflecting plate has a hemi-ellipsoidal shape, a light entrance port of the light collecting device is approximately centered at a focal point of the reflecting plate, and the color light generating device is disposed such that a light illumination spot on the wavelength conversion material is located approximately at the other focal point of the reflecting plate; and wherein when the reflecting plate has a hemispherical shape, the light entrance port of the light collecting device is located near a spherical center of the reflecting plate, and the color light generating device is disposed such that the light illumination spot on the wavelength conversion material is located at the spherical center of the reflecting plate and opposite to the light entrance port, or the color light generating device is disposed such that the light illumination spot on the wavelength conversion material is located near the spherical center of the reflecting plate at a point symmetrical to the light entrance port with respect to the spherical center.

9. A light guide component, comprising:

a first reflecting plate and a second reflecting plate disposed parallel to each other and joined to each other, the first and second reflecting plates each having a reflective surface facing a same direction, wherein a portion of the first reflecting plate has a first cutout and a portion of the second reflecting plate has a second cutout, wherein the portion of the first reflecting plate and the portion of the second reflecting plate overlap each other, and wherein the first cutout and the second cutout overlap each other to form an aperture; and a transflective coated plate disposed between the portion of the first reflecting plate and the portion of the second reflecting plate that overlap each other to form a stack, the transflective coated plate covering the aperture, wherein the transflective coated plate transmits light in a first wavelength range and reflects light in other wavelength ranges.

* * * * *